US009506374B2

(12) United States Patent
Batt

(10) Patent No.: US 9,506,374 B2
(45) Date of Patent: Nov. 29, 2016

(54) COMPONENT OF A TURBINE WITH LEAF SEALS AND METHOD FOR SEALING AGAINST LEAKAGE BETWEEN A VANE AND A CARRIER ELEMENT

(75) Inventor: Stephen Batt, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 536 days.

(21) Appl. No.: 13/812,153

(22) PCT Filed: Jul. 8, 2011

(86) PCT No.: PCT/EP2011/061641
§ 371 (c)(1),
(2), (4) Date: Jan. 25, 2013

(87) PCT Pub. No.: WO2012/016790
PCT Pub. Date: Feb. 9, 2012

(65) Prior Publication Data

US 2013/0183150 A1 Jul. 18, 2013

(30) Foreign Application Priority Data

Aug. 5, 2010 (EP) ..... 10171961

(51) Int. Cl.
*F01D 11/00* (2006.01)
*F01D 25/24* (2006.01)

(52) U.S. Cl.
CPC ..... *F01D 25/24* (2013.01); *F01D 11/003* (2013.01); *F01D 11/005* (2013.01); *F01D 25/246* (2013.01); *F05D 2240/57* (2013.01)

(58) Field of Classification Search
CPC ..... F05D 2240/57; F01D 11/003
See application file for complete search history.

(56) References Cited

U.S. PATENT DOCUMENTS

| | | | | |
|---|---|---|---|---|
| 4,712,979 | A * | 12/1987 | Finger | F01D 5/081 415/115 |
| 4,815,933 | A | 3/1989 | Drerup | |
| 5,118,120 | A | 6/1992 | Drerup | |
| 5,343,694 | A | 9/1994 | Schonewald | |
| 5,645,398 | A * | 7/1997 | Benoist et al. | 415/134 |
| 5,797,723 | A | 8/1998 | Frost | |
| 6,347,508 | B1 * | 2/2002 | Smallwood | F01D 9/023 60/796 |
| 6,464,232 | B1 * | 10/2002 | Marchi et al. | 277/630 |
| 6,666,645 | B1 | 12/2003 | Arilla | |
| 7,037,071 | B2 * | 5/2006 | Antunes | F01D 9/023 415/189 |
| 2009/0074562 | A1 | 3/2009 | Self | |
| 2009/0169370 | A1 | 7/2009 | Fonseka | |
| 2009/0322036 | A1 * | 12/2009 | Halling | 277/434 |

FOREIGN PATENT DOCUMENTS

| | | | |
|---|---|---|---|
| DE | 10306915 | A1 | 9/2004 |
| EP | 0526058 | A1 | 2/1993 |
| EP | 0716220 | A1 | 6/1996 |
| EP | 1296023 | A1 | 3/2003 |

(Continued)

*Primary Examiner* — Craig Kim
*Assistant Examiner* — Michael Sehn

(57) ABSTRACT

A component of a turbine includes a vane, a carrier element and at least four interfaces between the vane and the carrier element. The at least four interfaces are sealed via leaf seals. A method for sealing against leakage between a vane and a carrier element of the above-mentioned turbine component includes sealing the at least four interfaces by way of leaf seals.

2 Claims, 2 Drawing Sheets

(56) References Cited

FOREIGN PATENT DOCUMENTS

| | | | |
|---|---|---|---|
| EP | 1340885 | A2 | 9/2003 |
| EP | 1445537 | A2 | 8/2004 |
| EP | 2180143 | A1 | 4/2010 |
| SU | 1200609 | A1 | 10/1990 |
| WO | WO 2005033558 | A1 | 4/2005 |
| WO | WO 2009085949 | A1 | 7/2009 |
| WO | WO 2009158554 | A2 | 12/2009 |

* cited by examiner

COMPONENT OF A TURBINE WITH LEAF SEALS AND METHOD FOR SEALING AGAINST LEAKAGE BETWEEN A VANE AND A CARRIER ELEMENT

CROSS REFERENCE TO RELATED APPLICATIONS

This application is the US National Stage of International Application No. PCT/EP2011/061641, filed Jul. 18, 2011 and claims the benefit thereof. The International Application claims the benefits of European application No. 10171961.5 EP filed Aug. 5, 2010. All of the applications are incorporated by reference herein in their entirety.

FIELD OF INVENTION

The present invention relates to a component of a turbine. It further relates to a method for sealing against leakage between a vane and a carrier element of a turbine component.

BACKGROUND OF INVENTION

The air leakage between a turbine vane axial face and the corresponding feature of the carrier ring is required to be limited to a minimum. The turbine vane and carrier rings are subjected to thermal and mechanical loads which induce distortion and relative movement. Therefore, leakage between a turbine vane and the corresponding feature of the carrier ring may occur.

Previously, air leakage has been minimised with direct face-to-face contact, but has been prone to an unknown rate of leakage during service.

In U.S. Pat. No. 4,815,933 a boltless turbine nozzle and a nozzle support assembly that includes a turbine nozzle mounting flange seated in a nozzle seat forming a part of the nozzle support are disclosed. A pressure actuated pliable seal is affixed to the turbine nozzle adjacent to the nozzle seat in order to provide an air seal across the completed assembly.

In EP 1 340 885 A2 a leaf seal support for a gas turbine engine nozzle vane is described. The turbine nozzle assembly includes a plurality of segments joint together to form an outer band and a plurality of segments joined together to form an inner band. At least to one airfoil is positioned between the outer and inner bands. A leaf seal is attached to each inner band segment by at least one pin member and a leaf seal is attached to each outer band segment by at least one pin member.

In U.S. Pat. No. 5,118,120 an apparatus for effecting a seal between two structural components of a turbo machine or similar device is disclosed. The apparatus comprises a leaf seal located in the space between the two components.

In U.S. Pat. No. 5,797,723 and EP 0 526 058 A1 a turbine seal is disclosed. The turbine seal includes a first arcuate segment defining a flowpath boundary between combustion gases and air and includes a radially outwardly extending rail at one end thereof. A second arcuate segment is disposed coaxially with the first segment for defining a continuation of the flowpath boundary. It has a radially extending face adjoining the rail. A leaf seal bridges the rail and the face for sealing leakage there between. A plurality of pins extended through the leaf seal for providing the mounting to the rail.

In EP 1 445 537 A2 an assembly for providing a seal at an aft end of a combustor liner for a gas turbine engine is described. The sealing assembly includes a substantially annular first sealing member positioned between an aft portion of a support member and the liner aft end so as to seat on a designated surface portion of the liner aft end. A substantially annular second sealing member is positioned between the support member aft portion and a turbine nozzle located downstream of the liner aft end so as to seat on a designated surface portion of the support member aft portion. The first and second sealing members are maintained in their respective seating positions as the support member aft portion moves radially or axially with respect to the liner aft end and radially or axially with respect to the turbine nozzle. The first and second sealing members allow for axially and radially movement of the adjacent components.

In DE 103 06 915 A1 a sealing arrangement for gas turbines is disclosed. The described sealing member comprises a number of openings through which a fluid can pass the sealing member.

In WO 2005/033558 A1 a seal which comprises a first and a second component is disclosed. The seal is applied to a combustion chamber for a gas turbine. It comprises a spring load which provides a seal also in the case of vibrations in the combustion chamber. The seal is further applied to the sealing between adjacent stationary blade platforms in gas turbines. The seal comprises a number of openings for leading a fluid through the seal.

U.S. Pat. No. 5,343,694 a gas turbine nozzle including a plurality of nozzle segments having a pair of nozzle vanes supported by inner and outer shroud segments is disclosed. The outer shroud segment includes a generally axially extending platform with a circumferentially extending seal member attached to the upstream end thereof to seal with the combustor liner flange against the leakage there between. Moreover, a radially extending circumferential projection is attached to the downstream end of the platform for providing an engagement surface for a W seal to prevent leakage between the outer rotor casing and the shroud segment.

In WO 2009/085949 A1 and US 2009/0169370 A1 a turbine nozzle segment including a band having a plurality of tabs is disclosed. An airfoil extending from the band and a support structure attached to the tabs is described. The support structure has a plurality of biasing structures.

In US 2009/0074562 A1 a turbine nozzle guide vane with passages leading from a hollow core to respective seal strip slots to deliver cooling air to abutment faces on each end of the vane is disclosed.

In EP 2 180 143 A1 a gas turbine nozzle arrangement is disclosed. It comprises at least one seal strip which is present between a radially outer surface of a carrier ring section and inner surface of an inner platform and comprises openings for allowing cooling fluid to flow through the seal strip.

The document EP 1 296 023 A1 discloses a devise for holding strip sealing gaskets on a turbo machine nozzle.

The document WO 2009/158554 A2 describes a seal for containment of fluids or gases during high temperature applications.

In U.S. Pat. No. 5,118,120 entitled "leaf seal" an apparatus for effecting a seal between two structure components of a turbo machine is taught, comprising a leaf seal located in the space between the two components and a spring which continuously biases the leaf seal into a sealing position against the components regardless of the pressure differential across the leaf seal.

SUMMARY OF INVENTION

It is a first objective of the present invention to provide a component of a turbine with a reduced leakage between a vane and a carrier element. It is a second objective of the present invention to provide a method for sealing against leakage between a vane and a carrier element of a turbine component.

The above objectives are achieved by the features of the independent claim(s). The depending claims define further developments of the invention.

The inventive component of a turbine comprises a vane, a carrier element and at least four interfaces between the vane and the carrier element. The at least four interfaces are sealed by means of leaf seals. For example, the component may comprise at least four leaf seals for connecting the vane and the carrier element at the at least four interfaces. Sealing all four interfaces has the advantage, that a leakage between the vane and the carrier element, for example a carrier ring, can effectively be reduced. At the same time the inventive design allows for relative movement between the vane and the carrier element, whilst maintaining a known sealing performance. Preferably, the leaf seals are a sheetmetal leaf seals.

The turbine may comprise a carrier ring which comprises the carrier element. Alternatively, the carrier element can be designed as carrier ring.

Generally, the leaf seals can be connected to the vane and/or to the carrier element. Advantageously, the leaf seals may be connected to the vane and/or to the carrier element such that a movement between the vane and the carrier element is possible. For example, the turbine may comprise a rotation axis. At least one leaf seal can be connected to the vane and/or to the carrier element such that a movement between the vane and the carrier element in axial direction and/or tangential direction and/or radial direction relative to the rotation axis is possible. Preferably, at least one leaf seal can be connected to the vane and/or to the carrier element by means of at least one location pin. At least one leaf seal can allow for free movement by using location pins, for example with axial and tangential clearance.

At least one leaf seal may comprise means for leading a fluid through the seal. For example, at least one leaf seal may comprise at least one opening, preferably a number of openings, for leading a fluid through the seal. The vane may comprise a platform with an underside where the vane is connected to the carrier element and which may possibly be exposed to hot gases. For example, the leakage across one of the seals can be allowed to be a higher value compared with one of the other seals in order to supply cooling air to the underside of the platform of the vane. This allows for cooling the underside of the platform.

The turbine can comprise a rotation axis and the vane can comprise a trailing edge, a leading edge, a radially outer platform with a leading edge side and a trailing edge side, and a radially inner platform with a leading edge side and a trailing edge side. A first interface can be located at the leading edge side of the radially outer platform. A second interface can be located at the leading edge side of the radially inner platform. A third interface can be located at the trailing edge side of the radially outer platform. A fourth interface can be located at the trailing edge side of the radially inner platform. These four interfaces can each be sealed by means of a previously described leaf seal.

Generally, the turbine can be a gas turbine or a steam turbine.

The inventive method for sealing against leakage between a vane and a carrier element of a turbine component regards to a turbine component which comprises at least four interfaces between the vane and the carrier element. The at least four interfaces are sealed by means of leaf seals. The inventive method can be performed by means of the inventive component as previously described. Therefore, the inventive method has the same advantages as the inventive component.

Generally, the at least four interfaces may comprise the formerly described first interface and/or second interface and/or third interface and/or fourth interface.

Advantageously a fluid is led through the leaf seal, for example through openings of the leaf seal. Advantageously, air, especially cooling air, may be led through the leaf seal. This provides for an effective cooling of the sealed portions, especially of the underside of the platform of the vane.

In the context of the present invention the term "leaf seal" is used with the same meaning as the term is used in the cited state of the art documents, for example in U.S. Pat. No. 5,118,120, WO 2009/085949 A1 or US 2009/0169370 A1. The leaf seal may for instants be an apex seal, a seal face, a sealing strip, a lip seal, a gasket, a sealing washer or a seal washer.

In the present invention, the term "carrier element" is defined as an element to which the vane is connected. The carrier element may hold the vane in its correct position, for example in a turbine. A vane may typically be connected to at least two carrier elements. The vane may comprise a radially inner platform, an airfoil portion and a radially outer platform. The airfoil portion is located between the two platforms. Preferably, each platform is connected to a carrier element.

BRIEF DESCRIPTION OF THE DRAWINGS

Further features, properties and advantages of the present invention will become clear from the following description of an embodiment in conjunction with the accompanying drawings. All mentioned features are advantageous alone or in any combination with each other.

DETAILED DESCRIPTION OF INVENTION

An embodiment of the present invention will now be described with reference to FIGS. 1 to 3.

Figure 1:
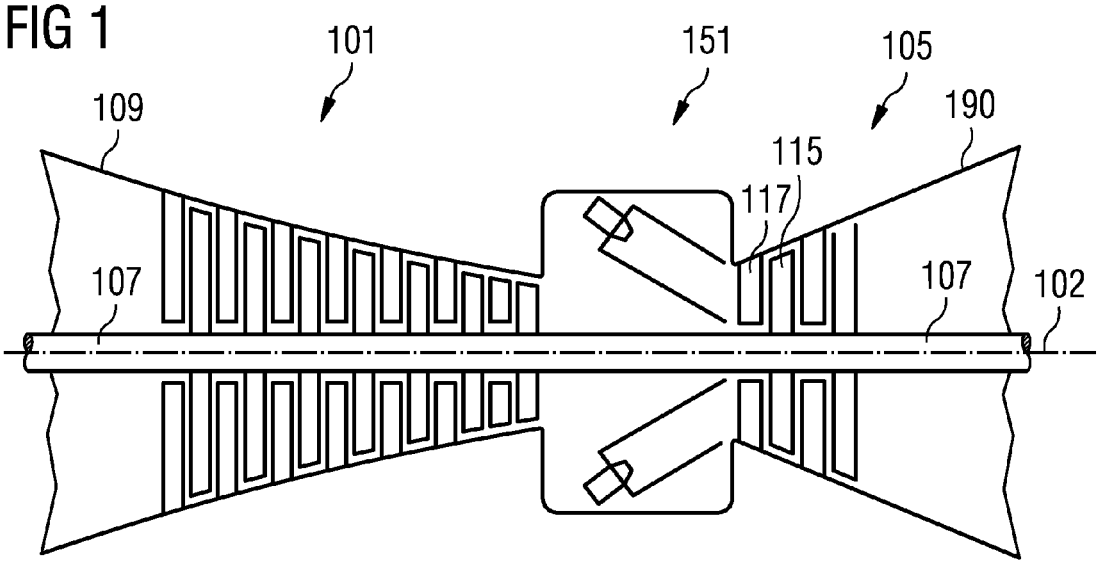
FIG. 1 schematically shows a gas turbine.

FIG. 1 schematically shows a gas turbine. A gas turbine comprises a rotation axis with a rotor. The rotor comprises a shaft 107. Along the rotor a suction portion with a casing 109, a compressor 101, a combustion portion 151, a turbine 105 and an exhaust portion with a casing 190 are located.

The combustion portion 151 communicates with a hot gas flow channel which may have a circular cross section, for example. The turbine 105 comprises a number of turbine stages. Each turbine stage comprises rings of turbine blades. In flow direction of the hot gas in the hot gas flow channel a ring of turbine guide vanes 117 is followed by a ring of turbine rotor blades 115. The turbine guide vanes 117 are connected to an inner casing of a stator. The turbine rotor blades 115 are connected to the rotor. The rotor is connected to a generator, for example.

During operation of the gas turbine air is sucked and compressed by means of the compressor 101. The compressed air is led to the combustion portion 151 and is mixed with fuel. The mixture of air and fuel is then combusted. The resulting hot combustion gas flows through a hot gas flow channel to the turbine guide vanes 117 and the turbine rotor blades 115 and actuates the rotor. The rotation axis of the turbine is designated by reference numeral 102.

Figure 2:
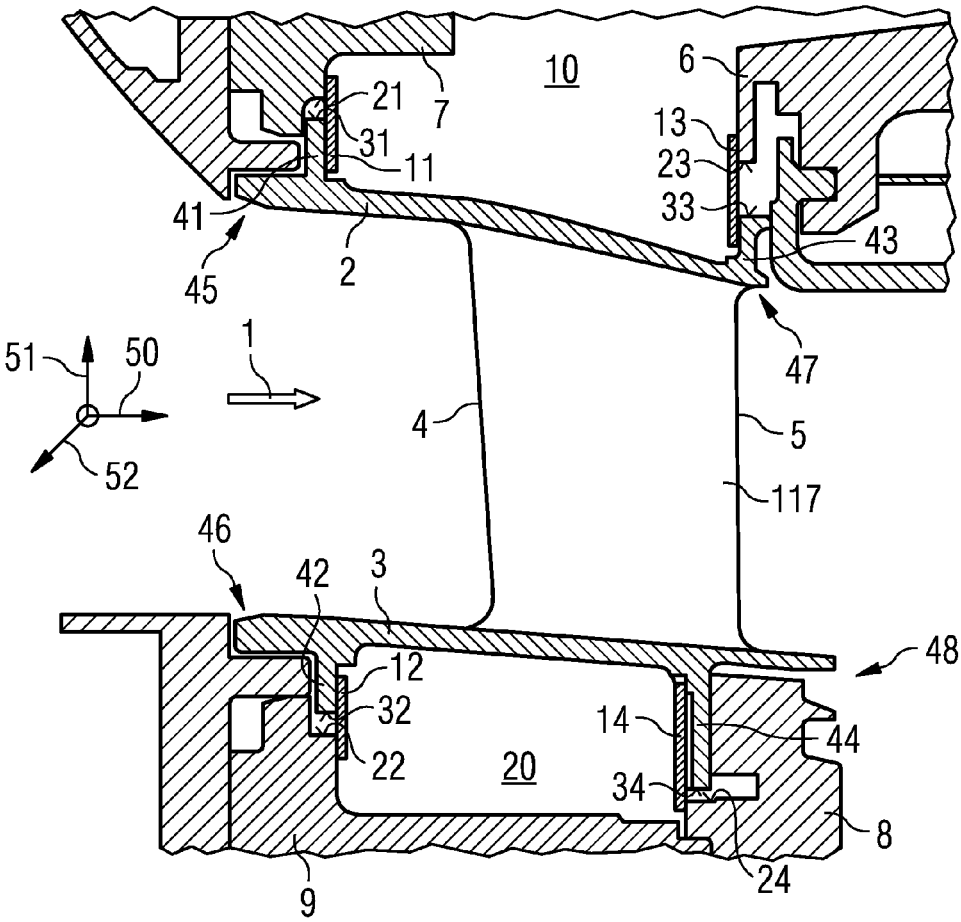
FIG. 2 schematically shows an inventive component of a turbine in a sectional view.

FIG. 2 schematically shows part of a turbine in a sectional view. The axial direction is designated by reference numeral 50, the radial direction is designated by reference numeral 51 and the tangential direction is designated by reference numeral 52. In FIG. 2 a vane 117 is connected to a number of carrier elements 6, 7, 8, 9. The vane 117 comprises a leading edge 4 and a trailing edge 5. The flow direction of the driving medium, for example gas or steam is indicated by an arrow 1.

The vane 117 comprises a radially outer platform 2 and a radially inner platform 3. The radially outer platform 2 comprises a leading edge side 45 corresponding to the leading edge 4 of the vane 117 and a trailing edge side 47 corresponding to the trailing edge 5 of the vane 117. The radially inner platform 3 comprises a leading edge side 46 corresponding to the leading edge 4 of the vane 117 and a trailing edge side 48 corresponding to the trailing edge 5 of the vane 117. By connecting the vane 117 to a number of carrier elements 6, 7, 8, 9 a number of interfaces between the vane 117 and the carrier element 6, 7, 8, 9 are established.

The radially outer platform 2 comprises a first protrusion 41 which is located at the leading edge side 45 of the radially outer platform 2 and a second protrusion 43 which is located at the trailing edge side 47 of the radially outer platform 2. The radially inner platform 3 comprises a first protrusion 42 at the leading edge side 46 and a second protrusion 44 at the trailing edge side 48.

A first interface is formed between a radially outer surface 31 of the first protrusion 41 of the radially outer platform 2 and a corresponding surface 21 of the carrier element 7. This first interface is sealed by means of a first leaf seal 11.

A second interface is formed between a radially inner surface 32 of the first protrusion 42 of the radially inner platform 3 and a corresponding surface 22 of the carrier element 9. This second interface is sealed by means of a second leaf seal 12.

A third interface is formed by a radially outer surface 33 of the second protrusion 43 of the radially outer platform 2 and a corresponding surface 23 of the carrier element 6. This third interface is sealed by means of a third leaf seal 13.

A fourth interface is formed between a radially inner surface 34 of the second protrusion 44 of the radially inner platform 3 and a corresponding surface 24 of the carrier element 8. This fourth interface is sealed by means of a fourth leaf seal 14.

The first leaf seal 11 can be connected to the carrier element 7 and/or to the radially outer platform 2, preferably to the first protrusion 41 of the radially outer platform 2, by means of retaining pins 15. The second leaf seal 12 can be connected to the carrier element 9 and/or to the radially inner platform 3, preferably to the first protrusion 42 of the radially inner platform 3, by means of retaining pins 15. The third leaf seal 13 can be connected to the carrier element 6 and/or to the radially outer platform 2, preferably to the second protrusion 43 of the radially outer platform 2, by means of retaining pins 15. The fourth leaf seal 14 can be connected to the carrier element 8 and/or to the radially inner platform 3, for example to the second protrusion 44 of the radially inner platform 3, by means of retaining pins 15.

All leaf seals 11, 12, 13, 14 can advantageously be sheetmetal leaf seals. Preferably, the retaining pins or location pins 15 which are used for connecting the leaf seals 11, 12, 13, 14 to the platforms 2, 3 and/or to the carrier elements 6, 7, 8, 9, are constructed such that a free movement between the platforms 2, 3 and the carrier elements 6, 7, 8, 9 is possible. Preferably, location pins with axial and tangential clearance are used. Retaining pins or location pins 15 allow for relative movement between the vane 117 and the corresponding carrier elements 6, 7, 8, 9, whilst the sealing performance is maintained.

Generally, the carrier elements 6, 7, 8, 9 can be part of carrier rings. For example, the carrier element 6 and/or the carrier element 7 can be part of a radially outer carrier ring. The carrier element 8 and/or the carrier element 9 can be part of a radially inner carrier ring.

Radially outside of the radially outer platform 2 a space 10 is formed under the radially outer platform 2. Radially inside of the radially inner platform 3 a space 20 is formed under the radially inner platform 3. The leaf seals 11, 12, 13, 14 effectively prevent a leakage of hot gases from a combustion chamber of the gas or steam turbine into the spaces 10 and 20 under the platforms 2 and 3. At the same time a movement between the vane 117 and the carrier element 6, 7, 8, 9, for example due to vibrations, is possible, whilst the sealing function of the leaf seals 11, 12, 13, 14 is maintained.

Figure 3:
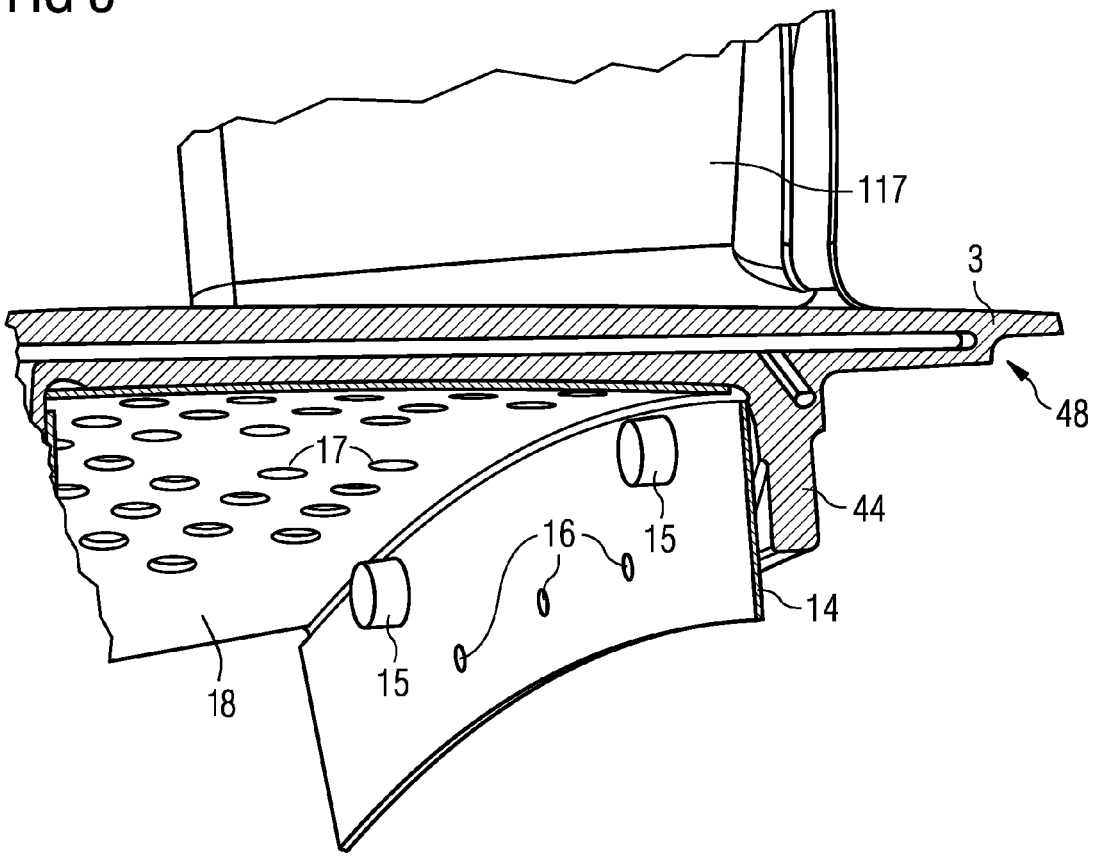
FIG. 3 schematically shows a leaf seal connected to the platform of a vane in a perspective view.

FIG. 3 schematically shows a leaf seal connected to a platform of a vane in a perspective view. In FIG. 3 the trailing edge side 48 of the radially inner platform 3 is shown as an example. The leaf seal 14 is connected to the second protrusion 14 of the radially inner platform 3 by means of retaining pins or location pins 15.

Additionally, a number of openings 17 are shown, which are located in an impingement plate 18 at the underside of the platform 3. These openings 17 can be used for cooling the underside of the platform 3 and/or for cooling vane 117.

The leaf seal 14 further comprises a number of openings 16. These openings 16 preferably have a smaller diameter than the openings 17 in the impingement plate at the underside of the platform 3. The openings 16 of the leaf seal 14 can be used for supplying cooling air or any other cooling medium to the underside of the platform 3. Preferably, the leakage across one of the seals 11, 12, 13, 14 can be allowed to be of a higher value in order to supply cooling air to the underside of the platform 3.

The arrangement shown in FIG. 3 has the advantage that a sealing against leakage of hot combustion gasses is provided, whilst at the same time a cooling of the underside of the platform 3 can be performed.

The other three leaf seals 11, 12, 13 can be constructed and connected in the same way as shown in FIG. 3.

The invention claimed is:

1. A component of a turbine comprising:

a vane, a carrier element, and at least four interfaces between the vane and the carrier element, wherein the at least four interfaces are sealed via respective four leaf seals, wherein the leaf seals are connected to the vane and/or to the carrier element, wherein at least one leaf seal is connected to the vane and/or to the carrier element such that a movement between the vane and the carrier element is possible, wherein the turbine comprises a rotation axis and at least one leaf seal is connected to the vane and/or to the carrier element such that a movement between the vane and the carrier element in axial and/or tangential and/or radial direction is possible, wherein the vane comprises a radially inner platform having an underside, wherein at least two of the interfaces are located at the radially inner platform, wherein an impingement plate is located at the underside of the radially inner platform, wherein the impingement plate includes a plurality of openings therethrough that facilitate cooling the underside of the radially inner platform, wherein at least one of the leaf seals that seals one of the at least two interfaces comprises at least one opening configured to supply a cooling medium to the underside of the radially inner platform, wherein the at least one opening in the at least one leaf seal is smaller than at least one of the openings through the impingement plate.

2. A method for sealing against leakage between a vane and a carrier element of a turbine component, wherein the turbine comprises a rotation axis, wherein the turbine component comprises at least four interfaces between the vane and the carrier element, the method comprising:

sealing the at least four interfaces via respective four leaf seals, wherein the leaf seals are connected to the vane and/or to the carrier element, wherein at least one leaf seal is connected to the vane and/or to the carrier element such that a movement between the vane and the carrier element is possible, wherein the at least one leaf seal is connected to the vane and/or to the carrier element such that a movement between the vane and the carrier element in axial and/or tangential and/or radial direction is possible, wherein the vane comprises a radially inner platform having an underside, wherein at least two of the interfaces are located at the radially inner platform, wherein an impingement plate is located at the underside of the radially inner platform, wherein the impingement plate includes a plurality of openings therethrough that facilitate cooling the underside of the radially inner platform, wherein at least one of the leaf seals that seals one of the at least two interfaces comprises at least one opening, wherein the at least one opening in the at least one leaf seal is smaller than at least one of the openings through the impingement plate, supply a cooling medium through the at least one opening in the at least one of the leaf seals to the underside of the radially inner platform.

* * * * *